United States Patent [19]

Guilbault et al.

[11] Patent Number: 4,624,677

[45] Date of Patent: Nov. 25, 1986

[54] METHOD FOR CONTROLLING ANTIMICROBIAL CONTENT OF FIBERS

[75] Inventors: Lawrence J. Guilbault; Thomas C. McEntee, both of Topsfield; Judith L. Koob, Danvers, all of Mass.

[73] Assignee: Morton Thiokol, Inc., Chicago, Ill.

[21] Appl. No.: 657,119

[22] Filed: Oct. 3, 1984

[51] Int. Cl.[4] ..... D06P 5/00; B32B 9/00; D02G 3/00

[52] U.S. Cl. ..... 8/490; 8/115.58; 8/115.59; 8/115.61; 8/115.62; 8/115.64; 8/115.65; 8/921; 8/922; 8/924; 428/361; 428/364; 428/365; 428/368; 428/395

[58] Field of Search ..... 8/115.58, 115.59, 115.64, 8/490, 115.61, 115.62, 115.65; 428/368

[56] References Cited

U.S. PATENT DOCUMENTS

| | | | |
|---|---|---|---|
| Re. 21,197 | 9/1939 | Hill et al. | 8/490 |
| 3,161,622 | 12/1964 | Harrington et al. | 424/27 |
| 3,197,430 | 7/1965 | Lowes | 8/490 |
| 3,198,764 | 8/1965 | Lowes | 428/401 |
| 3,198,765 | 8/1965 | Lowes | 8/490 |
| 3,284,395 | 11/1966 | Lowes | 424/27 |
| 3,288,878 | 11/1966 | Lowes | 585/659 |
| 3,345,341 | 10/1967 | Berry et al. | 428/907 |
| 3,959,556 | 5/1976 | Morrison | 428/364 |

FOREIGN PATENT DOCUMENTS 686992 9/1979 U.S.S.R. .

*Primary Examiner*—A. Lionel Clingman
*Attorney, Agent, or Firm*—Gerald K. White

[57] ABSTRACT

The use of a bath containing the same antimicrobial agent as that previously incorporated in a fiber permits the antimicrobial concentration in the fiber to be controlled when the fiber is processed through liquid media such as dye baths and the like.

26 Claims, 1 Drawing Figure

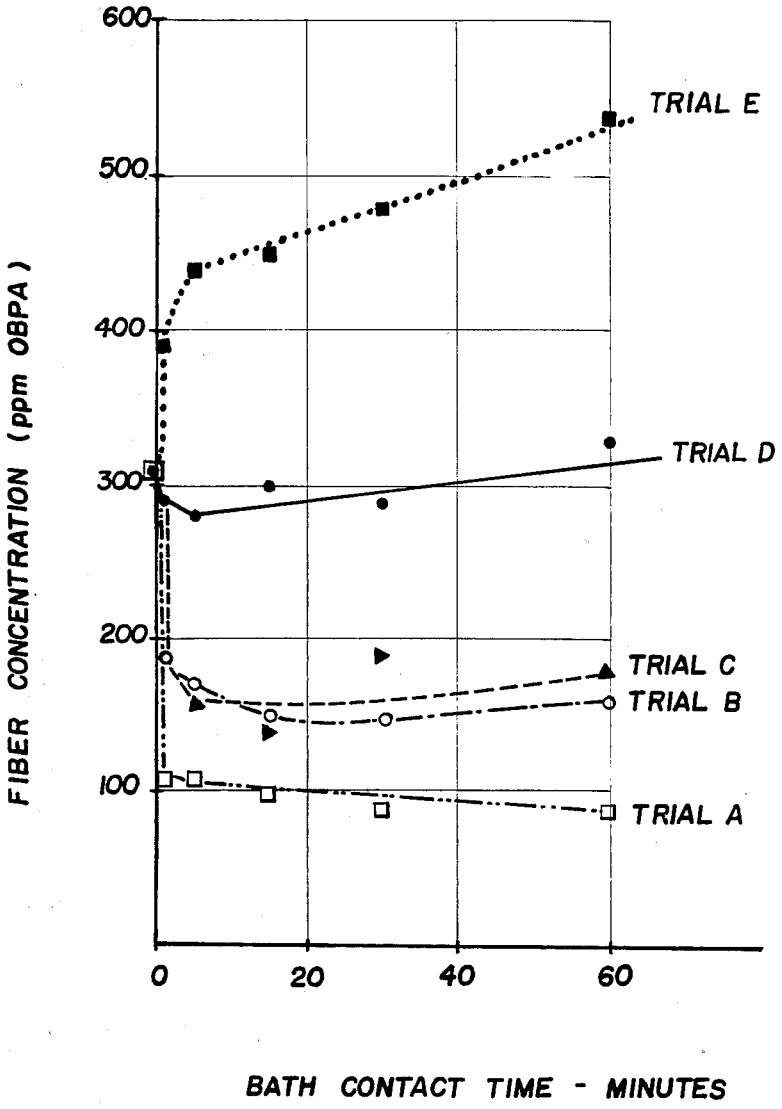
600
500
400
300
200
100
FIBER CONCENTRATION (ppm OBPA)
TRIAL E
TRIAL D
TRIAL C
TRIAL B
TRIAL A
0
20
40
60
BATH CONTACT TIME - MINUTES

METHOD FOR CONTROLLING ANTIMICROBIAL CONTENT OF FIBERS

CROSS REFERENCE TO OTHER APPLICATIONS

This application is related in subject matter to four other applications that were filed concurrently with this application and were commonly assigned. They are: Application Ser. No. 657,116, now U.S. Pat. No. 4,601,831, invented by Michael M. Cook and entitled "ANTIMICROBIAL ADJUSTMENT TECHNIQUE"; Application Ser. No. 657,118, now U.S. Pat. No. 4,592,843 invented by Lawrence J. Guilbault and Thomas C. McEntee and entitled "METHOD OF REMOVING A TOXICANT FROM WASTEWATER", Application Ser. No. 657,177, invented by Thomas C. McEntee, Lawrence J. Guilbault, Judith L. Koob and James F. Brophy and entitled "METHOD FOR INCORPORATING ANTIMICROBIALS INTO FIBERS"; and application Ser. No. 657,278, now abandoned, invented by Thomas C. McEntee, Lawrence J. Guilbault, Judith L. Koob and James F. Brophy and entitled "METHOD FOR INCORPORATING ANTIMICROBIALS INTO FIBERS".

BACKGROUND OF THE INVENTION

This invention generally pertains to a technique for controlling the concentration of previously incorporated antimicrobial agents during processing of the fiber following the initial incorporation procedure. This technique may be used to increase, decrease or maintain essentially constant the antimicrobial agent concentration of a fiber. A need for such a technique will become apparent from the following discussion in which a particular problem in the art is advantageously solved by this invention.

Antimicrobial agents, such as 10, 10'-oxybisphenoxarsine (OBPA), are known to serve to provide protection against bacterial attack of thermoplastic fiber materials, such as nylon. The incorporation of OBPA also serves to reduce the occurrence of mildew and other undesirable growths on the fiber when in final form such as carpeting, etc. In the prior art, OBPA has been initially incorporated into molten nylon to ensure its inclusion in the spun fiber product. This procedure results in an essentially homogeneous distribution of the OBPA through the nylon fiber cross-section. U.S. Pat. No. 3,345,341 is illustrative of such prior technique. However, subsequent bath dyeing of the fiber results in a loss, often of up to 70%, of the previously incorporated antimicrobial agent from the fiber. The loss is believed to be due to leaching of the antimicrobial agent, resulting in an equilibrium proportioning of the agent between the solid phase of the fiber and the liquid phase of the dye bath. Obviously one would need to incorporate inordinately large amounts of the antimicrobial agent to ultimately obtain an antimicrobially effective final concentration in the carpeting when losses on the order of 70% are encountered.

In the past, this loss problem has been avoided by using solution dyeing procedures in which the dye is incorporated into the melt along with the antimicrobial agent during the melt-spinning stage. For example, certain nylon carpet containing melt incorporated OBPA is currently manufactured in this manner. However, solution dyed carpeting is only available in a rather limited number of shades and, of course, can only be dyed by the fiber manufacturer. It would be desirable for the fiber manufacturer to be able to sell undyed bulk fibers which contain the antimicrobial agent so that the buyer can then process such bulk fiber into carpeting and then either dye the carpeting or have such operation performed at a custom dye house. This procedure would provide greater latitude as to color selection and provide greater flexibility in the overall manufacturing process. It is believed that the process of this invention overcomes the above mentioned problems in a highly advantageous and efficient manner.

SUMMARY OF THE INVENTION

The invention involves a method for controlling the concentration of antimicrobial agents that have been previously incorporated into fibers. The method generally comprises treating a fiber which contains an essentially homogeneously distributed antimicrobial agent by passing the fiber through a medium which contains the same antimicrobial agent as that contained in the fiber. The agent is presented in a concentration relative to that in the fiber which will produce a treated fiber containing a predetermined or desired concentration of antimicrobial agent.

BRIEF DESCRIPTION OF THE DRAWING

The sole FIGURE illustrates the influence of various concentrations of OBPA contained in a simulated beck dye bath upon the initial OBPA concentration of a nylon fiber.

DETAILED DESCRIPTION OF THE INVENTION

The concentration of antimicrobial agents initially present in fibers can be easily controlled through practice of the invention. For example, the concentration initially present in the fiber can be increased, decreased, or maintained relatively constant with respect to the original level through adjustment of the parameters of the process. Basically, the process involves treating a fiber containing a previously incorporated antimicrobial agent by passing the fiber through an antimicrobial agent containing medium. The relative concentration or ratio of agent in the fiber to that in the medium will usually provide the major control variable and thereby achieve the desired result of the process. It is also pointed out that time of passage and temperature of the fiber and medium are variables to consider when practicing the process of the invention. These variables are of a nature, however, that one skilled in the art could routinely develop suitable parameters for various combinations of fiber, medium, and specific antimicrobial agent.

It is contemplated that the invention may be practiced upon the fibers at any stage of fabrication including but not limited to mono-filiments, bulked continuous filiment, staple, skein yarn, stock yarn, woven goods, greige goods, nonwoven scrim, needle-punched goods, knites, etc. Conventional equipment utilized in dyeing of fibers provides a convenient vessel to contain the medium used for treatment of the fibers. For example, vats, stock dyeing, skein dyeing, rope dyers, continuous dye ranges, Kuesters or Becks and the like are suitable.

The method of antimicrobial content control in the fibers may be practiced during any stage of the fiber manufacture following the spinning operation. For example, the control process may be performed prior to, during or following a dyeing step where the antimicrobial agent is contained in a suitable media.

Fibers suitable for use in connection with the invention include synthetic, semisynthetic, or natural fibers or blends thereof. Synthetic fibers include but are not limited to polyamides such as Nylon 6 and Nylon 66, polyesters, polyacrylics, and modified cellulosics.

The major characteristic of the fiber selected is that it should be compatible with and capable of containing the antimicrobial agent. This characteristic would be readily determined and recognized by one skilled in the art.

While many antimicrobial agents would be suitable for use in connection with the practice of the invention, OBPA and others that leach into dye liquids are specifically contemplated.

Specific antimicrobial agents that may be employed include but are not limited to those described below.

Examples of the types of microbiocidal compounds which may be employed in this invention include, but are not limited to, phenoxarsines (including bisphenoxarsines), phenarsazines (including bisphenarsazines), maleimides, isoindole dicarboximides, having a sulfur atom bonded to the nitrogen atom of the dicarboximide group, halogenated aryl alkonals and isothiazolinone compounds. Organotin compounds are also specifically contemplated.

The microbiocidal phenoxarsine and phenarazine compounds useful in the compositions of this invention include compounds represented by the formulas:

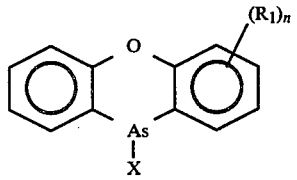

and

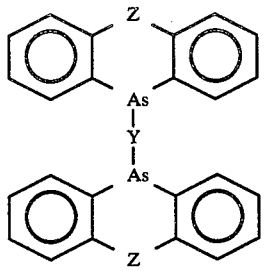

where x is halogen or thiocyanate, y is oxygen or sulfur, z is oxygen or nitrogen, R is halo or lower alkyl, and n is 9 to 3.

Examples of these phenoxarsines and phenarsazines include, but are not limited to, 10-chlorophenoxarsine; 10-iodophenoxarsine; 10-bromophenoxarsine; 4-methyl-10-chlorophenoxarsine; 2-tert-butyl-10-chlorophenoxarsine; 2-methyl-8,10-dichlorophenoxarsine; 1,3,10-trichlorophenoxarsine; 2,6,10-trichlorophenoxarsine; 1,2,4,10-thiocyanato phenoxarsine; and 10,10'-thiobisphenoxarsine; 10,10'-oxybisphenarsazine, 10,10'-thiobisphenarsazine, and 10,10'-oxybisphenoxarsine (OBPA).

The microbiocidal maleimide compounds useful in the compositions of this invention are exemplified by a preferred maleimide, N-(2-methylnaphthyl)maleimide.

The microbiocidal compounds useful in the practice of this invention which are isoindole dicarboximides having a sulfur atom bonded to the nitrogen atom of the dicarboximide group are compounds which contain at least one group having the structure:

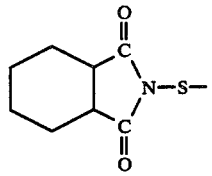

The preferred isoindole discarboximides are the following:

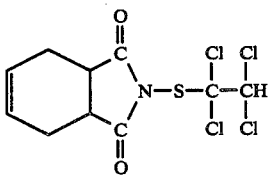

bis-N-[(1,1,2,2-tetrachloroethyl)thio]-4-cyclohexene-1,2-dicarboximide

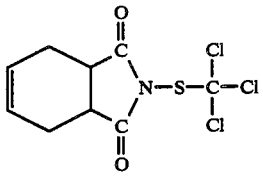

n-trichloromethylthio-4-cyclohexene-1,2-dicarboximide

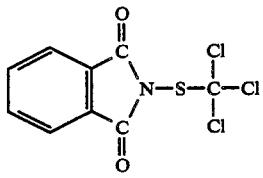

N-trichloromethylthio phthalimide

The halogenated aryl alkanols which can be used as microbiocidal compounds in accordance with this invention are exemplified by a preferred compound, 2,4-dichlorobenzyl alcohol.

An example of a preferred isothiazolinone compound useful in the composition of this invention is 2-(n-octyl-4-isothiazolin-3-one).

The most preferred microbiocidal compounds are the bisphenoxarsines and bisphenarsazines having the formula:

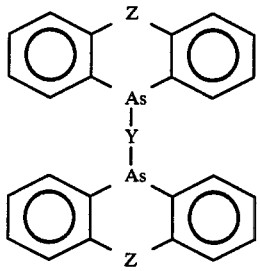

where Y is oxygen or sulfur and Z is oxygen or nitrogen. Of these bisphenoxarsines and bisphenarsazines, the most preferred are 10,10'-oxybisphenoxarsine; 10,10'-thiobisphenoxarsine; 10,10'-oxybisphenarsazine; and 10,10'-thiobisphenarsazine.

It is also within the scope of the invention to include other typical known antimicrobial agents such as bis(tri-n-butyl tin)oxide (TBTO) and the like.

Suitable media for passage of the fiber include those which are capable of dissolving or dispersing the antimicrobial agents. Obviously the selection of such media is dependent upon the nature of the agent. Again, such property would be readily determined by one skilled in the art. It is preferred that the medium be a liquid. Normally an aqueous solution of the antimicrobial agent constitutes the preferred medium for reasons of economy and availability. Beck dye baths constitute a typical aqueous medium. Such dye baths normally comprise a continuous water phase, or surfactant, a dye, and a pH adjusting agent. Other conventional dye baths such as continuous, disperse, foam, pad, and jet are also suitable for practice of the invention.

The resultant product of the invention exhibits the same distribution of antimicrobial agent across the cross-section of the fiber as that prior to practice of the invention, i.e.; a substantially homogeneous distribution. This product differs essentially from the surface treated fiber products taught in U.S. Pat. No. 3,966,659 due to the distribution profile.

The effect of variables that influence the invention is further illustrated by inspection of the Sole FIGURE. This FIGURE comprises a graph illustrating the effects of different concentration of OBPA in a simulated beck dye bath upon the resultant OBPA concentrations in the dyed Nylon 6 fibers. The beck dye bath was formulated by mixing 1 liter of tap water with 1 mL of TRITON-X 100 surfactant. The pH of this aqueous solution was adjusted to 4 with glacial acetic acid and then powdered OBPA was added to obtain the desired concentration. All starting nylon fibers contained a homogeneous OBPA distribution of 310 ppm.

The sole FIGURE illustrates the effects of various bath OBPA concentrations upon fiber OBPA concentrations as a function of time. Two different bath volume: fiber weight ratios were used. All trials were performed at 95° to 100° C. so as to simulate common industrial conditions.

The Table 1 provides a summary of pertinent information for Trials A-D which are plotted in the FIGURE.

TABLE 1

| Trial No. | Bath OBPA Concentration (ppm) | Bath (ml): Fiber g Ratio |
|---|---|---|
| A | 0 | 100:1 |
| B | 0 | 20:1 |
| C | 5 | 100:1 |
| D | 11 | 20:1 |
| E | 11 | 100:1 |

The data indicate that the absence of antimicrobial agent in the bath results in a dramatic and substantial loss of OBPA. This reflects the experience of the prior art. The data also indicate that a relatively low level of OBPA in the bath, such as 5 ppm, reduces the loss by a small amount thereby providing evidence of the ability to reduce OBPA concentration in a controlled fashion. A higher OBPA level in the bath at a ratio of 20/1 illustrates the ability to achieve a steady-state condition with minimal or no OBPA losses. The antimicrobial agent reaches an equilibrium apportionment between the solid phase (fiber) and the liquid phase (bath). This distribution is affected by bath concentration and bath temperature among other variables and is of a nature that is readily determinable by one skilled in the art for use in combination with a particular set of processing conditions.

Typical parameters that may be used in the practice of this invention include but are not limited to those set forth below. A range of bath volumes (mL) to fiber weight (g) ratios is from about 100:1 to 1:1; with the preferred ratios from 30:1 to 10:1. The latter ratio range is preferred because these ratios are commonly used in commercial dye operations. The partitioning distribution of OBPA between the fiber and the aqueous bath is typically within the range of 100:1 to 20:1. The range of bath OBPA concentration levels includes 1 ppm to 120 ppm; with the preferred range from 8 ppm to 15 ppm. The 8 to 15 ppm range is preferred because it maintains fiber OBPA concentration at common use levels. The range of initial OBPA concentrations in the fiber includes 10–3300 ppm; with a preferred range from 250 to 500 ppm because this level provides good antimicrobial protection. Treatment times range from less than one minute to greater than 60 minutes; with a preferred range from 5 to 30 minutes because it involves effective treatment within moderate handling times. The temperature ranges from 20° C. to 100° C.; with the preferred range of 40°–100° C. because OBPA uptake in the fiber is most efficient and much dyeing is done in this range. pH ranges from 4 to 7 and appears to have little or no effect on the partitioning of the OBPA.

We claim:

1. A method for obtaining a desired antimicrobial agent concentration in a fiber while passing said fiber through a liquid medium, comprising:

providing a fiber containing an initial concentration of antimicrobial agent that is essentially homogenously distributed throughout the fiber cross-section;

passing said fiber through a liquid medium which contains the same antimicrobial agent that is contained in said fiber, said antimicrobial agent in said liquid medium being controlled in a concentration relative to the initial concentration in said fiber whereby a desired, predetermined antimicrobial concentration in said fiber following its passage through said liquid medium is obtained.

2. The method of claim 1, wherein:
the medium contains a concentration of antimicrobial agent sufficient to result in essentially no change in the antimicrobial agent concentration of the fiber.
3. The method of claim 1, wherein:
the medium contains a concentration of antimicrobial agent sufficient to result in an increase in the antimicrobial agent concentration of the fiber.
4. The method of claim 1, wherein:
the medium contains a concentration of antimicrobial agent sufficient to result in a decrease in the antimicrobial agent concentration of the fiber.
5. The method of claim 1, wherein:
said medium is an aqueous medium.
6. The method of claim 1, wherein:
said fiber is a member selected from the group consisting of synthetic fiber, semisynthetic fibers, natural fibers or blends thereof.
7. The method of claim 5, wherein:
said fiber is nylon.
8. The method of claim 7, wherein:
said antimicrobial agent is 10,10'-oxybisphenoxarsine.
9. The method of claim 8, wherein:
a bath volume of fiber weight ratio of from about 100:1 to 1:1 is utilized.
10. The method of claim 9, wherein:
a ratio of from about 30:1 to 10:1 is utilized.
11. The method of claim 8, wherein:
a partitioning distribution of the 10,10'-oxybisphenoxarsine between said fiber and said medium from about 100:1 to 20:1 is utilized.
12. The method of claim 8, wherein:
said 10,10'-oxybisphenoxarsine concentration in the medium is from about 1 ppm to 120 ppm.
13. The method of claim 12, wherein:
said 10,10'-oxybisphenoxarsine concentration in the medium is from about 8 ppm to 15 ppm.
14. The method of claim 8, wherein:
said 10,10'-oxybisphenoxarsine initial concentration is said fiber is from 10 ppm to 3300 ppm.
15. The method of claim 14, wherein:
said 10,10'-oxybisphenoxarsine initial concentration is from about 250 ppm to 500 ppm.
16. The method of claim 14, wherein:
said 10,10'-oxybisphenoxarsine concentration in the medium is from about 1 ppm to 120 ppm.
17. The method of claim 8, wherein:
said aqueous medium also functions to dye the fiber during passage through the medium.
18. The method of claim 17, wherein:
said medium is a beck dye bath.
19. The method of claim 1, wherein:
said antimicrobial agent is a member of the group consisting of phenoxarsines, phenarsazines, maleimides, isoindole dicarboximides having a sulfur atom bonded to the nitrogen atom of the dicarboximide group, halogenated aryl alkanols, isothazolinones, and organotin compounds.
20. The method of claim 1, wherein:
said antimicrobial agent is n-(2-methylnaphthyl)-maleimide.
21. The method of claim 1, wherein:
said antimicrobial agent is bis-n-[(1,1,2,2-tetrachloroethyl)]-4-cyclohexene-1,2-dicarboximide.
22. The method of claim 1, wherein:
said antimicrobial agent is n-trichloromethylthio-4-cyclohexene-1,2-dicarboximide.
23. The method of claim 1, wherein:
said antimicrobial agent is n-trichloromethylthio phthalimide.
24. The method of claim 1, wherein:
said antimicrobial agent is 2,4-dichlorobenzyl alcohol.
25. The method of claim 1, wherein:
said antimicrobial agent is 2-(n-octyl-4-isothiazolin-3-one.
26. The method of claim 1, wherein:
said antimicrobial agent is bis(tri-n-butyltin)oxide.

* * * * *

UNITED STATES PATENT AND TRADEMARK OFFICE

CERTIFICATE OF CORRECTION

PATENT NO. : 4,624,677

DATED : Nov. 25, 1986

INVENTOR(S) : Lawrence J. Guilbault et al.

It is certified that error appears in the above-identified patent and that said Letters Patent is hereby corrected as shown below:

Column 3, line 10, change "containing" to -dispensing-.

Column 3, after line 19, insert the follow paragraph:

-- A wide variety of microbiocidal compounds are useful in the practice of this invention. In general, the useful microbiocidal compounds possess microbiocidal activity and are so soluble in an aryl alkanol. If the aryl alkanol/microbiocidal compound solution is to be employed in compositions containing polymer processing aids and/or polymers, the microbiocidal compound should be compatible with such processing aids or polymers.--

Column 3, line 27-28, delete the sentence:
"Organotin compounds are also specifically contemplated."

Column 6, line 41, change "concentrations" to -concentration-.

Signed and Sealed this

Twenty-sixth Day of May, 1992

*Attest:*

DOUGLAS B. COMER

*Attesting Officer*

*Acting Commissioner of Patents and Trademarks*